United States Patent [19]

Smith

[11] Patent Number: 4,627,204

[45] Date of Patent: Dec. 9, 1986

[54] SIMULATED LOG END UNIT FOR BUILDINGS

[76] Inventor: Leedice S. Smith, Rte. 1, Box 155-A, Spokane, Wash. 99009

[21] Appl. No.: 720,998

[22] Filed: Apr. 8, 1985

[51] Int. Cl.[4] ..... E04B 1/10

[52] U.S. Cl. ..... 52/233; 52/312

[58] Field of Search ..... 52/233, 312, DIG. 8

[56] References Cited

U.S. PATENT DOCUMENTS

| | | |
|---|---|---|
| 1,445,738 | 2/1923 | Adams . |
| 1,655,701 | 1/1928 | Hyland et al. . |
| 1,953,460 | 4/1934 | Bernhard . |
| 2,320,466 | 6/1943 | Presley . |
| 2,787,029 | 4/1957 | Johnson . |
| 3,377,758 | 4/1968 | Witschnig . |
| 4,012,876 | 3/1977 | Grubbs . |
| 4,288,954 | 9/1981 | O'Donnell . |
| 4,320,610 | 3/1982 | Rupp . |
| 4,503,648 | 3/1985 | Mahaffey ..... 52/233 X |

*Primary Examiner*—Carl D. Friedman

*Attorney, Agent, or Firm*—Wells, St. John & Roberts

[57] ABSTRACT

A simulated log end is produced from side panels including one or more transversely aligned and oppositely facing courses of preformed log siding. Front and back panels space the side panels apart so that the longitudinal axis of the siding outer faces is centered between the side panels. A visual pattern of concentric rings on the front panel simulates the growth rings of logs having the diameter of the partial cylindrical outer surfaces of the siding courses. The simulated log end unit can be used individually as a projection from a wall covered with preformed log siding, or can be arranged in vertical columns to simulate conventional log building corner joints.

18 Claims, 16 Drawing Figures

FIG 6
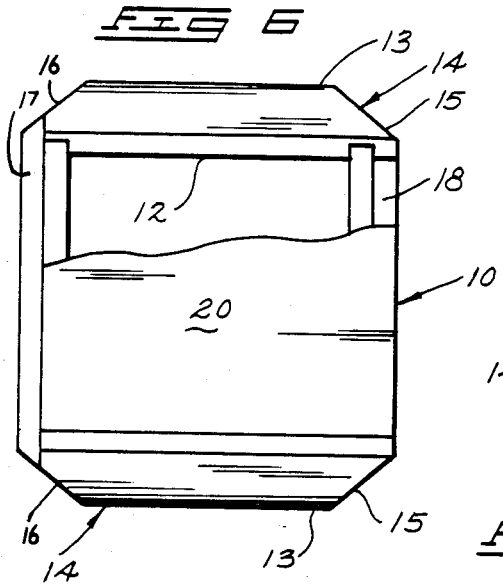
FIG 5
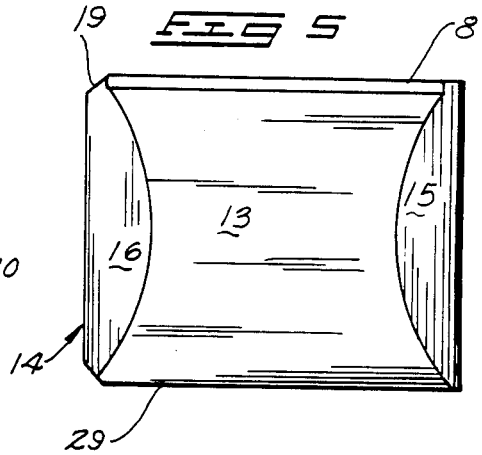
FIG 7
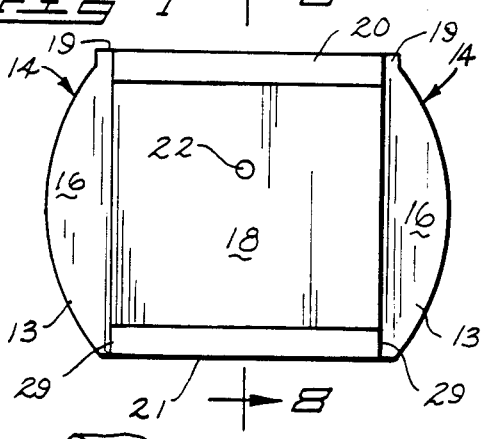
FIG 8
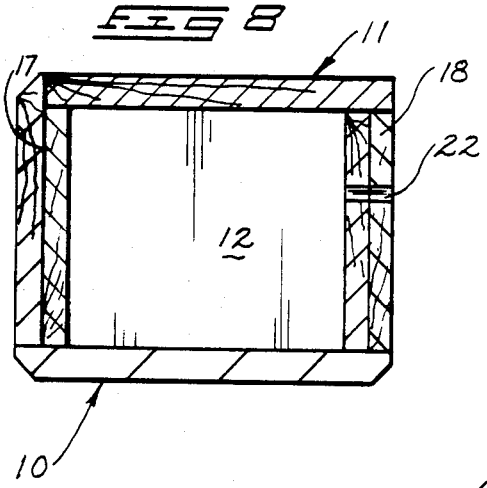
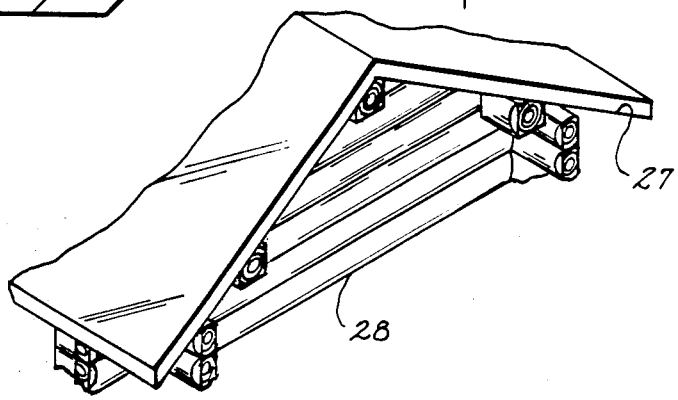
FIG 9

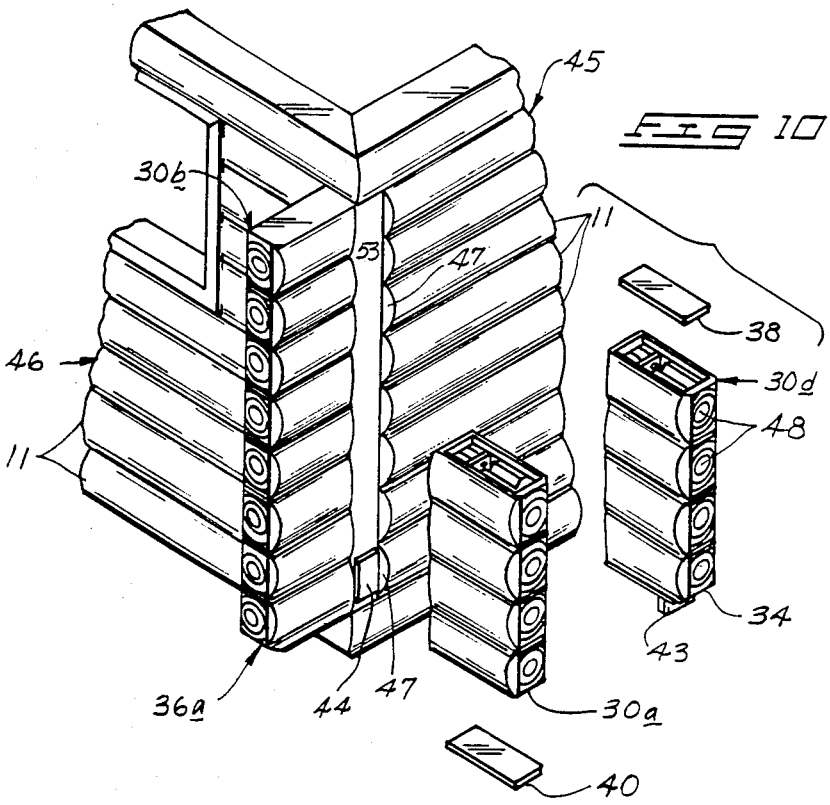
FIG 10
FIG 11
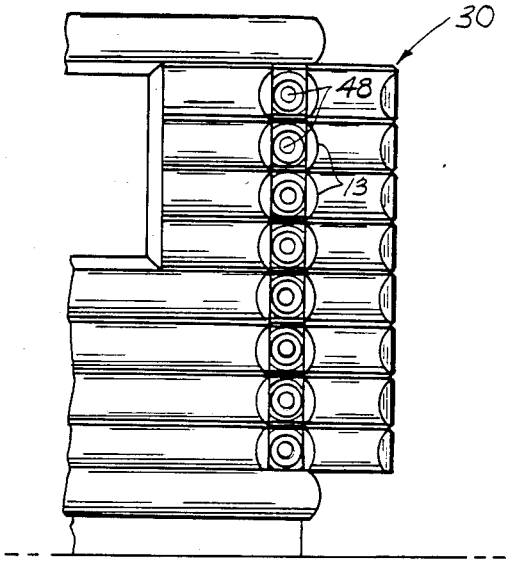

SIMULATED LOG END UNIT FOR BUILDINGS

FIELD OF THE INVENTION

This disclosure relates to a simulated log end unit adapted to be structurally mounted to the exterior of a building covered by simulated log siding. It presents the outward appearance of a log end complementary to the configuration of the log siding with which it is used.

BACKGROUND OF THE INVENTION

The popularity of log buildings has resulted in increased use of log siding which simulates the exterior appearance of real logs. Such siding is relatively thin and can be applied to the exterior of a conventional building frame in a manner similar to other forms of siding. The outward appearance of the installed siding looks very much like that of a wall constructed from machined logs.

A unique characteristic of most genuine log buildings is the appearance of the vertical columns of projecting log ends typically arranged at each building corner. In most such buildings, the logs are interconnected at the building corners by overlapping saddle joints, leaving projecting the outer log ends arranged in two perpendicular, vertical columns. The exposed outer end grain of the stacked log ends along each column visually contrasts with the longitudinal grain and wood characteristics of the sides of the logs adjacent to them.

The present invention arose from an effort to produce a lightweight simulated log end unit that could project outwardly from simulated log siding to mimic the appearance of a building constructed from real logs. It presents the outward appearance and charm of a log building without the expense of full log construction. It also facilitates the construction of buildings utilizing conventional framing and wall insulation, while presenting the outward appearance of conventional real log construction.

The invention has been directed to construction of individual log end units, as well as multiple log end units arranged in vertical columns. Both types of units are similarly attached to the usual building frame by bolts or other suitable structural connections to provide rigid, long lasting structural attachments at the building exterior.

BRIEF DESCRIPTION OF THE DRAWINGS

The invention is illustrated in the accompanying drawings, in which:

FIG. 5 is a side view;

FIG. 6 is a top view with a portion of the cover broken away;

FIG. 7 is a rear view;

FIG. 8 is a vertical sectional view taken along line 8—8 in FIG. 7;

FIG. 9 is a perspective fragmentary view of a typical building end wall including the simulated log end units;

FIG. 10 is a partially exploded fragmentary perspective view illustrating the multiple log end units at a typical building corner;

FIG. 11 is a fragmentary front view of the completed building corner shown in FIG. 10;

DETAILED DESCRIPTION OF THE PREFERRED EMBODIMENT

Figure 1:
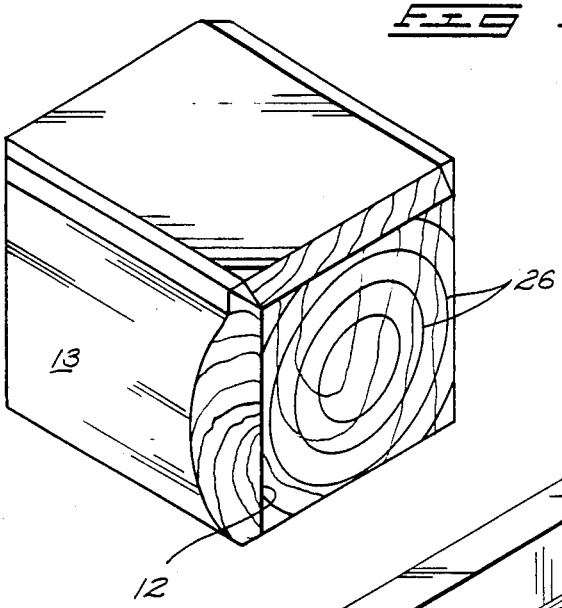
FIG. 1 is a perspective illustrative view of a single log end unit constructed according to this disclosure.

In compliance with the constitutional purpose of the Patent Laws "to promote the progress of science and useful arts" (Article 1, Section 8), applicant submits the following disclosure of the invention.

This disclosure relates to a hollow simulated log end unit designed to complement conventional simulated log siding used in building construction. FIGS. 1 through 9 show details of a single log end unit, which might project beneath the roof of a building to simulate the outer ends of roof supports typically used in a genuine log building. FIGS. 10 through 16 show details of a multiple unit which can be vertically stacked at the corners of a building to simulate the projecting outer ends of the logs used in the construction of a genuine log wall.

Both embodiments of the simulated log unit comprise a hollow structure including longitudinally spaced back and front panels, and transversely spaced side panels, in which the side panels are constructed from the preformed log siding with which the log end unit is to be utilized. One or more sets of concentric rings are visually presented on the front panel of each unit to simulate the end grain appearance of wood logs.

The single simulated log end unit shown in FIGS. 1 through 9 is adapted to project perpendicularly outward at a mitered end of a course of preformed log siding on a building wall. In a typical siding installation of this type, the preformed siding includes a planar innerface and an opposite outer face that has the form of a partial cylinder. The maximum transverse depth of the preformed siding is less than the cylindrical radius of curvature of its outer face.

The simulated log end unit in FIGS. 1–9 uses a course of the preformed siding as each of two side panels. They are equal in length and transversely spaced apart from one another with their respective outer faces directed outwardly from and centered about a common longitudinal axis. Each side panel also has a mitered back edge and a longitudinally spaced front edge, both extending between parallel upper and lower edges along the side panels. A front panel joins the two side panels and has an outer plane surface closing off the space that separates the inner faces of the two side panels in a location flush with their respective front edges. A back panel is spaced longitudinally from the front panel and also joins the two side panels. This combination presents a hollow structure that can be rigidly attached to a building frame member to simulate a log end projecting perpendicularly from a building wall.

The multiple log end unit illustrated in FIGS. 10 through 15 is adapted to project perpendicularly outward at the aligned mitered ends of several courses of preformed log siding on a building wall. In includes a pair of side panels each formed from an equal multiple number of courses of the preformed siding. They are cut to equal lengths and arranged in positions corresponding to the multiple courses of preformed siding from which the log end unit is to be projected. The corresponding courses of siding on each of the side panels are transversely spaced apart with their outer faces directed outwardly and centered about a vertical line of common longitudinal axes. Again, each side panel has a mitered back edge and a longitudinally spaced front edge, both extending between parallel upper and lower edges along the side panels. The structure is completed by a front panel that joins the two side panels and by a back panel longitudinally spaced from the front panel and also joining the two side panels. This multiple log end unit can be rigidly attached at the corners of a building in vertical stacks to simulate the usual perpendicular columns of protruding log ends.

Figure 2:
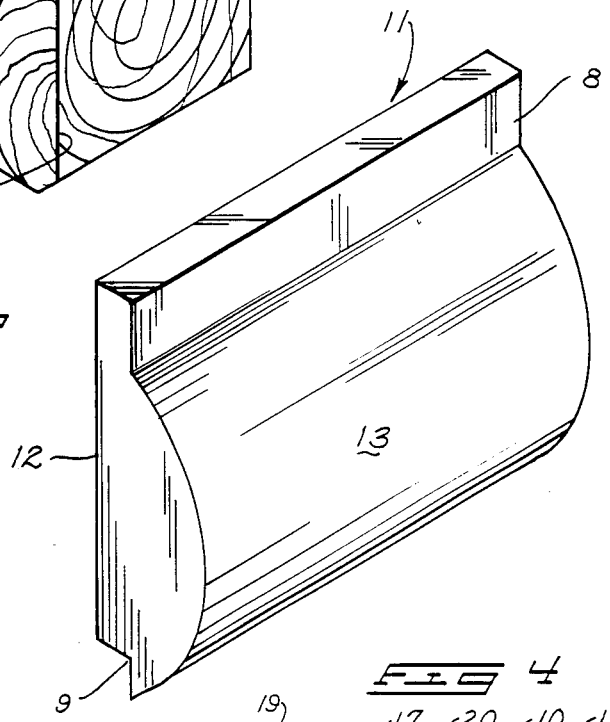
FIG. 2 is a fragmentary perspective view of a single course of preformed siding.
Figure 3:
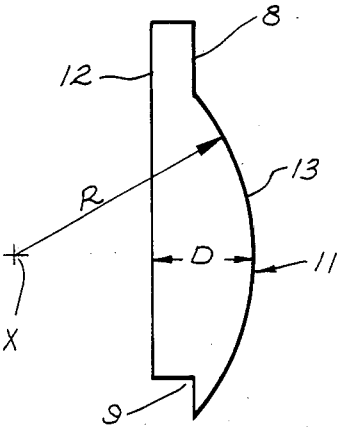
FIG. 3 is a diagrammatic cross-sectional view of the preformed siding.

FIGS. 2 and 3 illustrate a typical course of preformed log siding that might be used in the construction of a simulated log building. The preformed log siding 11 includes a planar face 12 and an opposite outer face 13 that has the form of a partial cylinder. The siding also includes a longitudinal groove 9 formed along one longitudinal edge, and an oppositely protruding tongue 8 formed along its remaining longitudinal edge. The groove 9 is adapted to receive and partially overlap the tongue 8 of an adjacent course of the preformed log siding 11, thereby producing an exterior wall configuration that visually simulates that of a genuine log wall. When used in constructin of log end units according to this disclosure, a portion of tongue 8 might be trimmed off and the groove 9 might be filled to present a full end configuration across the arcuate solid siding profile.

As is evident in FIG. 3, the simulated log siding 11 has a transverse thickness substantially less than the cylindrical radius of curvature of its outer face 13. The maximum transverse depth of the preformed log siding 11 is indicated in FIG. 3 by the letter D. The cylindrical radius of curvature of the outer face 13 of the siding is indicated by the letter R. The longitudinal axis of the partial cylinder presented along outer face 13 is indicated by the letter X.

The construction of the single simulated log end unit is detailed in FIGS. 4 through 8. It comprises a pair of side panels 14. Each side panel 14 is produced from a single course of the preformed siding. For this purpose, at least part of the protruding tongue 8 should be trimmed away, leaving the exterior of the siding in essentially curved form. The two side panels 14 in each unit are equal in length. They are transversely spaced apart from one another with their respective outer faces 13 directed outwardly from and centered about a common longitudinal axis identical to the axis X designated in FIG. 3.

Each side panel 14 also has a mitered back edge 15 adapted to abut a complementary mitered edge of the wall siding course from which the simulated log end unit 10 is to project. The side panels 14 are completed by a longitudinally spaced front edge 16. Both the mitered back edge 15 and the front edge 16, which is preferably mitered as shown, extend between parallel upper and lower edges 19 and 29 along the side panels 14.

A front panel 17 joins the two side panels 14. It has an outer plane surface closing off the space separating the inner faces 12 of the two side panels 14 in a location flush with their respective front edges 16. The upper and lower edges of the front panel can be beveled, as shown, to present a more pleasing total appearance in the completed unit.

A back panel 18 also joins the two side panels 14. Both the front panel 17 and the back panel 18 can be interlocked within vertical grooves in the side panels 14 to strengthen the unit 10. The unit is completed by a top cover 20 and a bottom cover 21, each set flush with the respective upper edges 19 and lower edges 29 of the side panels 14.

Figure 4:
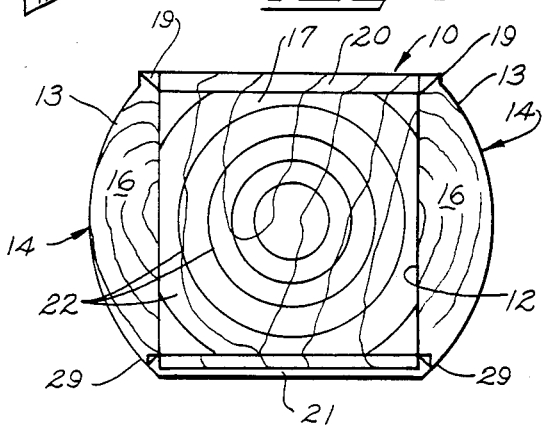
FIG. 4 is a front view of the unit shown in FIG. 1 with illustrated wood grain.
Figure 12:
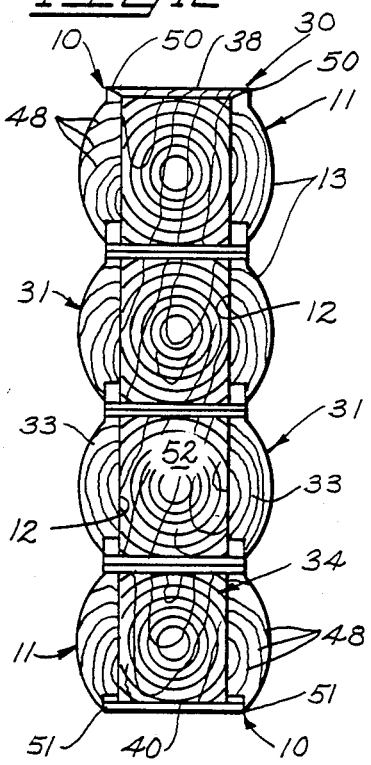
FIG. 12 is an enlarged front view of a multiple log end column, showing wood grain.
Figure 13:
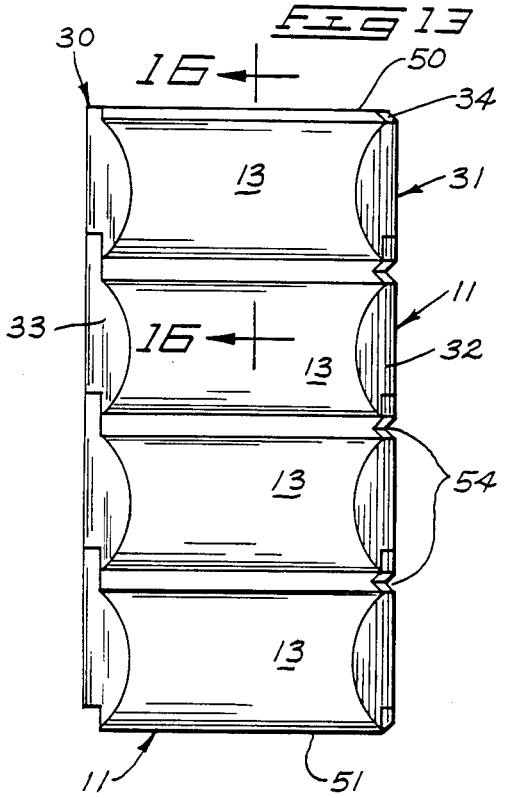
FIG. 13 is a side view of the column shown in FIG. 12.

As shown specifically in FIGS. 1 and 4, the outer surface of the front panel 17 presents a visual pattern of concentric rings 26 of increasing diameter. The concentric rings, which can be scored or printed on a planar outer surface of the panel 17, are centered on the common longitudinal axis of the outer faces 13 of the two side panels 14 at each side of the assembled unit. The concentric rings 26 simulate the growth rings visible across the outer end of a wood log. When viewed in conjunction with beveled ends of the simulated log siding at each side of the assembled unit, the entire structure closely simulates the appearance of an actual log end. This simulation is visually enhanced by the pattern of rings centered about the cylindrical axis of the siding outer faces 13, as can be seen in FIG. 4. It is also enhanced by the cross grain wood structure visible across the mitered front edges 16 of the two side panels 14. The wood grain visible in the finished product has been lightly illustrated on the surfaces shown in FIGS. 1 and 4 to assist in visualizing the illusion of a real log that is presented by this assembly.

The simulated log end units 10 can be readily attached to supporting building frame members by means of one or more supporting bolts (not shown) engaged to the building frame through holes 22 formed through the back panel 18.

FIG. 9 generally illustrates use of the single unit to simulate log ends projecting beneath the roof 27 along a building wall 28. As previously mentioned, the units 10 are mounted to the building frame with the mitered back edges 15 of their side panels 14 abutting similarly mitered vertical edges of the courses of simulated log siding applied across the building wall 28. The result is a lightweight, hollow rigid assembly that decoratively simulates real log ends and enhances the exterior appearance of the building.

Referring now to FIGS. 10 through 16, the multiple unit 30 essentially comprises an integrated stack of units 10 adapted to simulate a column of projecting log ends. Multiple unit 30 includes a pair of side panels 31. Each side panel 31 is formed from an equal multiple number of courses of the preformed log siding 11 generally shown in FIGS. 2 and 3. The courses of siding are cut to equal lengths and arranged one above the other upwardly along each side panel 31 in positions corresponding to the multiple courses of preformed siding on a building wall from which the unit 30 is to be projected.

The corresponding courses of the preformed log siding 11 aligned across from one another on the unit 30 on each of the side panels 31 are transversely spaced apart. Their outer faces 13 are directed outwardly and are centered about common longitudinal axes. Each axis is the longitudinal cylindrical axis of the outer siding surface, shown as axis X in FIG. 3. The individual axes are vertically aligned in the multiple unit 30 within a central plane separating the two side panels 31. The several axes are located at the centers of the concentric rings 48 described below.

Each side panel 31 has a mitered back edge 32 and a longitudinally spaced front edge 33, which is preferably mitered in a direction opposite to the back edge 32. The mitered back edge is adapted to abut a complementary mitered edge presented by the adjacent simulated log siding on a building wall. The mitered front edge assists in completing the visual illusion of a real log end in the completed assembly. Both the back edge 32 and the front edge 33 extend between parallel upper and lower edges 50 and 51 along the side panels 31.

An upright front panel 34 joins the two side panels 31. It includes an outer plane surface 52 that encloses the space between the inner faces 12 of the side panels 31. The surface 52 is located in a plane that is flush with the respective front edges 33 of the two side panels 31.

The multiple unit 30 is completed by a rigid back panel assembly including an inner plate 37 interlocked within vertical grooves formed along the inner faces 12 of the side panels 31, a pair of vertical side rails 36 which are transversely spaced apart, and a covering outer plate 35. These components are rigidly joined to one another to present a hollow vertical box frame running along the back side of the multiple unit 30. It provides a rigid "backbone" to support the overhanging weight of the multiple unit 30 when secured to a wall frame.

Two or more multiple units 30 can be stacked to form a column of simulated log ends as required by a particular building design. The multiple units 30 are completed by a top cover 38 fitted across the upper end of the top unit 30 in a column on a building. Similarly, a fitted bottom cover 40 is fastened across the bottom end of the lowermost unit 30 in a building column.

Figure 15:
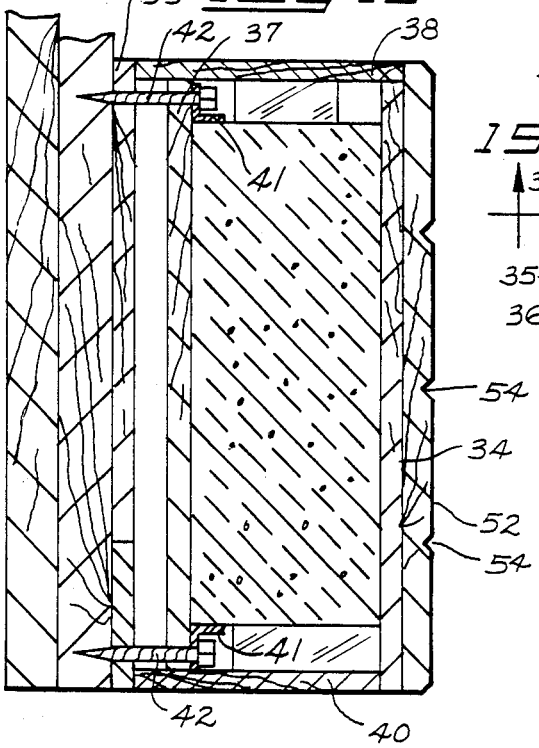
FIG. 15 is a central vertical section view through a mounted multiple log end column as seen generally in line 15—15 in FIG. 14.
Figure 14:
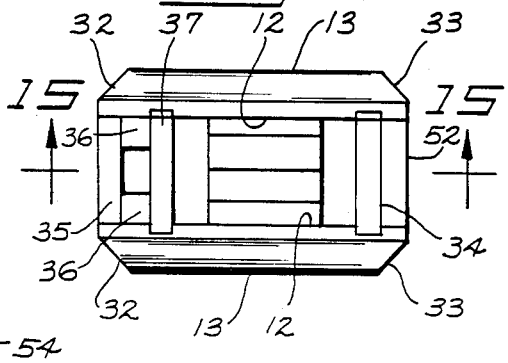
FIG. 14 is a top view of the column shown in FIG. 12.
Figure 16:
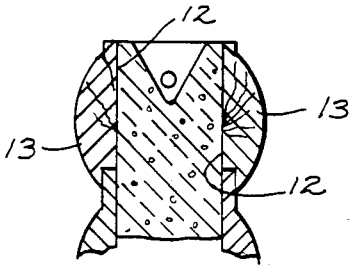
FIG. 16 is a fragmentary sectional view taken along line 16—16 in FIG. 13.

The multiple units 30 are held in place on a building by bolts 42 which extend through the back panel assembly (FIG. 15). Bolts 42 preferably extend through separable metal angle braces 41 that bear against the inside surfaces of the inner plates 37 at the back of each unit 30. The braces 41 spread the pressures exerted on the heads of the bolts 42 transversely across the width of the inner plate 37 and the rigid frame formed by side rails 36 and outer plate 35.

The assembly of a column made from multiple unit 30 can best be understood from FIG. 10. This drawing shows perpendicular building walls 45 and 46 produced from the preformed log siding 11. Vertically aligned mitered ends 47 are formed adjacent to each building corner. The mitered ends 47 partially overlap the vertical building frame member 53. FIG. 10 shows one assembled column of simulated log ends, which includes a lower multiple unit 30A and an upper multiple unit 30B. The view also illustrates the components of an unassembled column, which includes a lower multiple unit 30C and an upper multiple unit 30D. The column also requires final assembly of a top cover 38 and a bottom cover 40.

The lower and upper multiple units in a particular column are essentially identical. However, in order to facilitate alignment of the individual units, it is desirable to interlock the front ends of abutting units. This can be accomplished by downwardly projecting transverse guides 43 at the lower end of each unit which is to be stacked on a unit beneath it. The guides 43 can simply comprise a transverse board adapted to fit between the inner faces 12 of the transversely spaced side panels 31 at a location adjacent to the front panels 34. The rear alignment along the simulated log ends is achieved by abutting the mitered ends 47 in a straight line, and rigidly securing the rear ends of the units 30 by the supporting bolts 42. The interlocking guides 43 will maintain the appearance of a vertical column of log ends and prevent the outer ends of the units from separating due to warping or other aging conditions to which the assembly will be subjected.

Each front panel 34 is provided with a visual pattern of concentric rings 48 centered about the respective axes of the cylinders presented by the outer faces 13 of the vertically stacked courses of preformed siding 11 in side panels 31. While the front panel 34 is an integral board or sheet extending between several courses of siding, the visual patterns of concentric rings will present the appearance of several natural log ends, rather than one joining element. This visual illusion is further enhanced by transverse beveled grooves 54 that extend across the front panel 34 and the front edges 33 of the side panels 31 between the respective courses of preformed log siding 11. The visual effect is believed to be evident from FIGS. 11 and 12.

While the simulated log end units described above are exterior components of a building, and cannot contribute to interior insulation, they are enhanced by filling the hollow spaces within them with lightweight building insulation material. As shown in FIG. 15, the insulating material of choice is a foamed lightweight resin that is poured and foamed in place after the unit is fully assembled. The foam substantially fills the interior of each unit, thereby preventing the entrance of small animals or insects that might utilize the hollow interior spaces for nesting purposes. It also bonds to the interior surfaces of the unit and assists in rigidifying the assembled structure.

To assist in mounting the lower unit 30 on the frame member 53, it is preferable that the lowermost units 30 include an outer plate 35 in the back panel assembly that terminates short of the bottom of the unit. A plate 44 of identical thickness and width can then be attached to the exterior of the frame member 53 as shown in FIG. 10. The upper edge of the plate 44 will support the weight of the lower unit 30 while it is being secured to the frame member 53 by means of its upper bolt 42. The support plate 44 is not necessary for temporarily holding the upper units in a column, since their weight can be temporarily supported by the units beneath them.

By utilizing the single and multiple simulated log end units disclosed above, one can produce a simulated log building from preformed log siding. Such a building can be constructed by use of conventional frame construction techniques, and will present the outward appearance of a real log building. Construction of such a building is more economical, and requires less wood than would be devoted to a solid log construction system. Furthermore, the resulting building has hollow exterior walls to facilitate wiring, plumbing, heating and cooling ducts, vents and other building utilities. The hollow walls can be efficiently insulated by use of modern building insulation materials. The result is a building that simulates the outer appearance of a traditional log building, but has the economic and structural advantages of more modern building techniques.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

What is claimed is:

1. A simulated log end unit for buildings usage, comprising;

a back panel adapted to be rigidly attached to an upright building frame member, said back panel having oppositely facing side edges;

a pair of side panels constructed from preformed log siding and including opposed front and back edges, wherein the front edges of the side panels are mitered toward their respective back edges, the back edges of the side panels being rigidly attached to the side edges of the back panel at right angles thereto;

a planar front panel rigidly attached between and flush with the mitered front edges of the side panels;

and one or more sets of concentric rings visually presented on the exterior of said front panel, said rings simulating the end grain of wood logs.

2. The simulated log end unit of claim 1 wherein each side panel comprises one or more horizontal courses of preformed log siding.

3. The simulated log end unit of claim 1, wherein said back panel is spaced from said front panel.

4. A simulated log end unit adapted to project perpendicularly outward at a mitered end of a course of preformed log siding on a building wall, wherein said preformed siding includes an inner face and an opposite outer face that has the form of a partial cylinder, the maximum transverse depth of the preformed siding being less than the cylindrical radius of curvature of its outer face; said simulated log end unit comprising:

a pair of side panels each made from said preformed siding, the side panels being equal in length and being transversely spaced apart from one another with their respective outer faces directed outwardly from and centered about a common longitudinal axis;

each side panel also having both a mitered back edge and a longitudinally spaced mitered front edge, extending between parallel upper and lower edges;

a front panel joining the two side panels, said front panel having an outer plane surface closing off the space separating the inner faces of the two side panels in a location flush with their respective mitered front edges, said outer plane surface presenting a visual pattern of concentric rings of increasing diameter centered on a common longitudinal axis of the outer faces of the preformed siding in said side panels;

and a back panel spaced longitudinally from the front panel, said back panel also joining the two side panels.

5. The simulated log end unit of claim 4 further comprising:

top and bottom panels spaced apart from one another and respectively joined across the upper edges and lower edges of the pair of side panels.

6. The simulated log end unit of claim 4 wherein the visual pattern of concentric rings is scored about the outer surface of said front panel.

7. A simulated log end unit as set out in claim 4 wherein the front and back panels each have side edges physically interlocked with the respective inner faces of the preformed siding in said side sections.

8. A simulated log end unit adapted to project perpendicularly outward at the aligned mitered ends of a multiple number of courses of preformed log siding on a building wall, wherein each course of said preformed log siding includes a longitudinal inner face and an opposite longitudinal convex outer face in the form of a partial cylinder, the maximum transverse depth of the courses of preformed siding being less than the cylindrical radius of curvature of the siding outer face; said simulated log unit comprising:

a pair of side panels each formed from an equal multiple number of courses of said preformed siding cut to equal lengths and arranged in positions corresponding to the multiple courses of preformed siding from which the log end unit is adapted to be projected, corresponding courses of the preformed log siding being transversely aligned across from one another with their outer faces directed outwardly and centered about common longitudinal axes;

each of said side panels having a mitered back edge and a longitudinally spaced mitered front edge extending between parallel upper and lower edges;

a front panel joining the two side panels, said front panel having an outer plane surface enclosing the space between the inner faces of the side panels across a plane flush with their respective mitered front edges, said outer plane surface presenting a visual pattern of concentric rings of increasing diameter centered on said common longitudinal axes;

and a back panel spaced longitudinally from the front panel and joining the two side panels.

9. The simulated log end unit of claim 8, wherein the back panel comprises a hollow, rectangular box frame joined across the inner faces of said side panels.

10. The simulated log end unit of claim 8, wherein the front edge of each side panel is mitered in a direction opposite to the miter formed along its back edge.

11. The simulated log end unit of claim 8, wherein the resulting space between the inner faces of the side panels and the front and back panels is substantially filled with a thermal insulating material.

12. The simulated log end unit of claim 11, wherein the thermal insulating material is a foamed resin.

13. In a simulated log building:

an upright structural frame including vertical frame members;

a multiple number of vertically stacked courses of preformed log siding attached to said frame and terminating at vertically aligned mitered siding ends partially overlapping a vertical frame member, wherein each course of said preformed log siding includes a longitudinal inner face and an oppositely facing longitudinal convex outer face in the form of a partial cylinder, the maximum transverse depth of the preformed siding being less than the cylindrical radius of curvature of the siding outer face;

and a first simulated log end unit attached to the vertical frame member and projecting perpendicularly outward from the vertically aligned mitered siding ends, said simulated log unit comprising:

a pair of side panels each formed from an equal multiple number of courses of said preformed siding cut to equal lengths and arranged in positions corresponding to the multiple courses of preformed siding from which the log unit is adapted to be projected, corresponding transversely aligned courses of the preformed log siding on each of side panels being spaced apart with their outer faces directed outwardly and centered about common longitudinal axes:

each of said side panels having a mitered back edge and a longitudinally spaced mitered front edge extending between parallel top and bottom panel edges;

a front panel joining the two side panels, said front panel having an outer plane surface enclosing the space between the inner faces of the side panels across a plane flush with their respective mitered front edges said outer plane surface presenting a visual pattern of concentric rings of increasing diameter centered on said common longitudinal axes;

and a back panel spaced longitudinally from the front panel and joining the two side panels, said back panel being attached to said vertical frame member with the mitered back edge of one of said side panels abutting the vertically aligned mitered siding ends and with the courses of preformed siding in both side panels respectively aligned with a corresponding number of courses attached to said frame.

14. The simulated log building of claim 13 wherein the back panel comprises a hollow rectangular box frame joined across the inner faces of said side panels and fastened to the vertical frame member by vertically spaced bolts.

15. The building of claim 13 further comprising:

fixed support means on said vertical frame member for engagement by said back panel to thereby vertically position said first simulated log unit on said vertical frame member.

16. The building of claim 13 further comprising:

a second simulated log end unit identical to said first simulated log end unit, said second simulated log end unit also being attached to the vertical frame member in a stacked arrangement vertically above said first simuulated log end unit;

and interlocking means on said first and second simulated log end units for vertically aligning the top panel edges of the side panels in said first simulated log end unit with the bottom panel edges of the side panels in said second simulated log end unit.

17. A simulated log end unit for building usage, comprising:

a back panel adapted to be rigidly attached to a building frame member, said back panel having oppositely facing side edges;

a pair of side panels constructed from preformed log siding and including opposed front and back edges wherein the front edges of the side panels are mitered toward their respective back edges, the back edges of the side panels being rigidly attached to the side edges of the back panel at right angles thereto;

a planar front panel rigidly attached between and flush with the mitered front edges of the side panels;

and one or more sets of concentric rings visually presented on the exterior of said front panel, said rings simulating the end grain of wood logs.

18. The simualted log end unit of claim 17, wherein said back panel is spaced from said front panel.

* * * * *